United States Patent [19]

Sowards

[11] 4,075,953

[45] * Feb. 28, 1978

[54] LOW POLLUTION INCINERATION OF SOLID WASTE

[75] Inventor: Norman K. Sowards, Coeur d'Alene, Id.

[73] Assignee: Energy Products of Idaho, Coeur d'Alene, Id.

[ * ] Notice: The portion of the term of this patent subsequent to Nov. 29, 1994, has been disclaimed.

[21] Appl. No.: 807,866

[22] Filed: Jun. 20, 1977

Related U.S. Application Data

[63] Continuation-in-part of Ser. No. 591,556, Jun. 30, 1975, Pat. No. 4,060,041.

[51] Int. Cl.[2] ..... F23G 5/00; F23D 19/00

[52] U.S. Cl. ..... 110/8 F; 110/1 J; 110/28 J; 34/57 A

[58] Field of Search ..... 110/1 J, 8 R, 8 A, 8 F, 110/15, 28 J; 34/57 A

[56] References Cited

U.S. PATENT DOCUMENTS

| | | | |
|---|---|---|---|
| 3,397,657 | 8/1968 | Tada | 110/8 F |
| 3,508,341 | 4/1970 | Price | 34/57 A |
| 3,552,033 | 1/1971 | Steever et al. | 34/57 A |
| 3,799,747 | 3/1974 | Schmalfeld et al. | 110/8 F |
| 3,818,846 | 6/1974 | Reese | 34/57 A |
| 3,823,676 | 7/1974 | Cook et al. | 110/1 J |
| 3,863,577 | 2/1975 | Steever et al. | 110/8 R |
| 3,871,285 | 3/1975 | Bastgen | 110/15 |
| 3,888,193 | 6/1975 | Kishigami et al. | 110/8 A |
| 3,892,046 | 7/1975 | Cooke | 110/28 J |
| 3,907,674 | 9/1975 | Roberts et al. | 110/28 J |

*Primary Examiner*—Kenneth W. Sprague
*Attorney, Agent, or Firm*—Lynn G. Foster

[57] ABSTRACT

An incinerator system and method wherein pieces of solid waste, such as fragments of wood, are conveyed in such a fashion as to become disposed within a fluidized bed of an incinerator vessel. Preferably the solid waste particles are caused to be somewhat homogeneously dispersed within the fluidized bed. The solid waste particles may be "pre-dried" or moisture may be added to the particles prior to deposition in the fluidized bed for optimum results, depending upon circumstances. In one embodiment, the fluidized bed is situated above an air delivery chamber at the bottom of the vessel and supports combustion of the solid waste particles in the fine granular material comprising the fluidized bed. The fine granular material is supported by a perforated plate. The air delivery system channels high temperature air into and up through the fluidized bed until operating temperature is reached and so channels ambient air thereafter. Volatile matter given off by combustion of the solid waste particles in the fluidized bed is burned smokelessly in the vapor space immediately above the bed. A vortex generator system is used with or without vertical stagnation columns so that all air flow caused by the heat of the bed is collected in an annular ring near the wall of the vessel which centrifuges fine particles comprising the bed as well as some of the small pieces of solid waste which escape from the bed prior to full combustion. Other pieces of solid waste are retained within the vapor space of the vessel due to the increased residence time created by the vortex generator system until consumed. Thus, efficiency is increased. Special bed nozzles supported by the perforated plate in one embodiment or by air ducts in another embodiment and to which air from the air delivery system is selectively channeled aids in improved combustion providing below the horizontal plane defined by the outlets of the bed nozzles a region in which tramp material is either trapped and stored or trapped and removed in a manner preventing deterioration of the good quality fluidized bed properties necessary for optimum combustion. A novel fluidizing air system comprising parallel, spaced air ducts, creating uniform air distribution and nozzle discharge, accommodates continuous recirculation and purification of bed material during normal burner operation is provided as is the unique use of olivine as the bed material and the novel injection of fuel into the burner using an air jet mechanism.

4 Claims, 13 Drawing Figures

LOW POLLUTION INCINERATION OF SOLID WASTE

BACKGROUND

Continuity

This application is a continuation-in-part of my copending U.S. Pat. Application Ser. No. 591,556, filed June 30, 1975, now U.S. Pat. No. 4,060,041, issued Nov. 29, 1977.

FIELD OF INVENTION

The present invention relates generally to incineration or pyrolysis of waste and more particularly to smokeless, low pollution fluidized bed combustion of pieces of solid organic waste, such as wood waste, municipal refuse, industrial solid waste including agricultural residues, livestock refuse, and volatile matter given off by the solid waste and, if desire, incineration of carbonaceous residue produced by combustion of the solid waste. More specifically, the present invention relates to a novel bed nozzle system for maintaining good quality fluidized bed properties allowing tramp material to be isolated and removed, to a novel vortex generator system for increasing the residence time of any solid waste particle and for centrifuging particles from the fluidized bed and solid waste particles, to novel bed material and to a novel air jet injection of fuel into the burner.

PRIOR ART

The known prior art comprises expensive incineration of solid waste which results in substantial atmospheric pollution and which are difficult and costly to maintain. Substantial supervision is required and combustion is often incomplete due to a number of factors including inadequate residence time. Also, the fine particles from the fluidized bed are often carried away in the exhaust.

BRIEF SUMMARY AND OBJECTS OF THE INVENTION

An essentially pollution-free fluidized bed incineration or pyrolysis system and method wherein solid pieces of waste are continually fed, preferably by an air jet injection system so as to become deposited within a fluidized bed near the bottom of a combustion vessel. The pieces of solid waste are preferably distributed so as to be somewhat homogeneously disposed within the fluidized bed, uniquely comprising olivine. A novel vortex generator system is provided with or without vertical stagnation columns causing air to lift from the fluidized bed in a vortical pattern which increases the residence time of particles disposed in the vapor space above the fluidized bed allowing for the same to be consumed or returned due to centrifugal force to the bed. In like fashion, fine particles from the fluidized bed per se initially lifted by the air flow within the vapor space are centrifuged and returned to the bed. Uniquely, bed nozzles are disposed above an air distribution system comprising air ducts and nozzles to which fluidizing air is uniformly channeled. The fluidized bed is disposed above the air distribution system, creating a zone at the bottom of the fluidized bed adapted to receive tramp material in a continuous fashion during operation thereby obviating what would otherwise be a material decrease in desirable bed properties during operation. A system is provided for continuously removing the tramp material from said zone; it is contemplated that some bed material will also be continuously removed from said zone, segregated from the tramp material and returned to the bed. Back flow of the particulate matter of the fluidized bed is prevented, air flow into the bed through the ducts and through the bed nozzles being evenly distributed, and erosion of the duct work by the particulate matter is prevented. Initially, temperatures within the system may be set by a start-up heater and elevated to full incineration capacity by combustion of the volatiles within the vapor air space. Either complete incineration or recovery of a carbonaceous residue and generation of a combustible gas may be accomplished depending upon temperatures of operation and oxygen availability. The exhaust from the vessel may be processed to other mechanisms for removal of any residual solid particles in one or more known ways.

Accordingly, it is a primary object of the present invention to provide a novel incinerating or pyrolysis system and method.

Another paramount object of the present invention is to provide a novel fluidized bed arrangement including bed nozzles for use in incineration and pyrolysis.

A further dominant object is the provision of a novel vortex generator system to increase residence time of solid waste particles in a vapor zone above a fluidized bed in a vessel thereby accommodating full combustion of such particles either in the vapor space or by returning the same to the fluidized bed through centrifugal force, and preventing loss of fine particles from the fluidized bed.

An additional principal object is the provision of a novel air jet fuel injection system for use in solid waste incineration or pyrolysis.

Another primary object is the provision of a unique system for isolating and removal of tramp material during incineration or pyrolysis.

A further important object is the provision of a novel system for recycling and purifying bed material.

One more significant object is the provision of a novel bed material comprising olivine in a fluidized bed for incineration, pyrolysis, or gasification.

These and other objects and features of the present invention will be apparent from the following detailed description taken in reference to the accompanying drawings.

DETAILED DESCRIPTION OF THE ILLUSTRATED EMBODIMENTS

Figure 1:
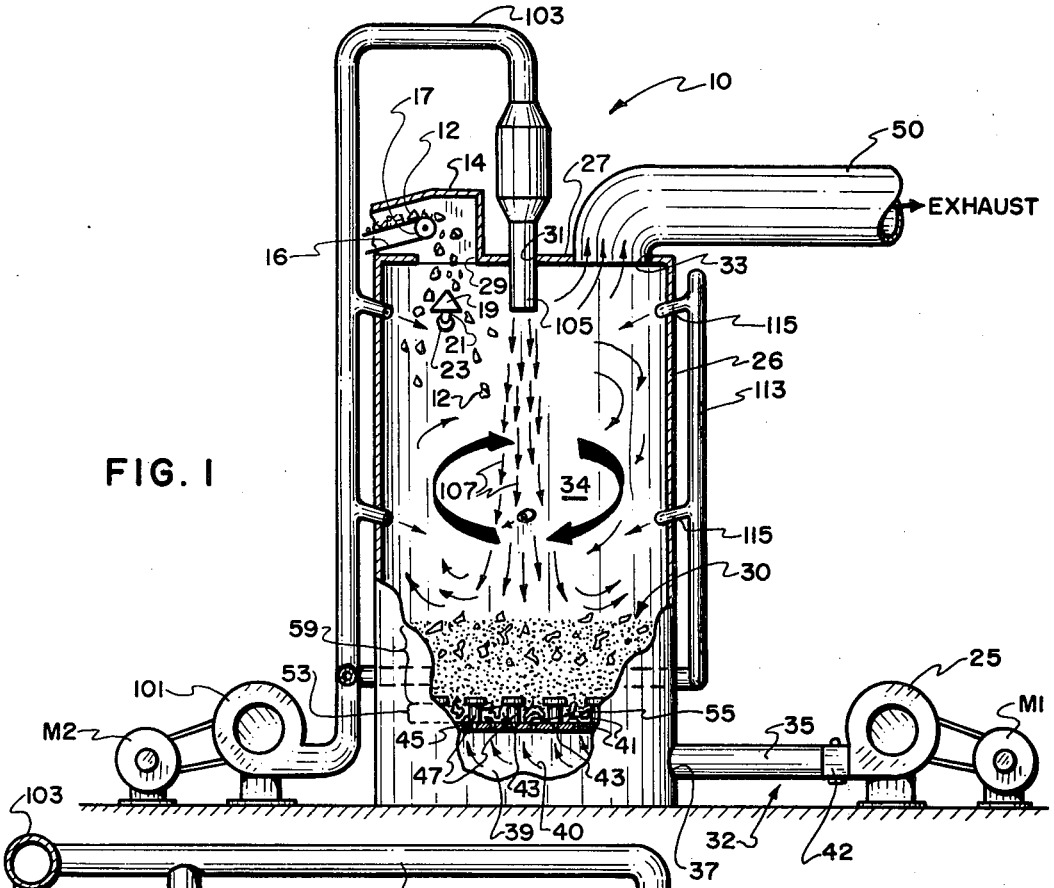
FIG. 1 is an elevational schematic of an incinerator in accordance with the present invention, with parts broken away for the purpose of clarity.

Reference is now made to the embodiment illustrated in FIGS. 1-9 wherein like numerals are used to designate like parts throughout. Broadly, the solid organic waste low pollution incinerator, generally designated 10, comprises apparatus for continually delivering fuel which may comprise pieces of solid waste 12 to an incineration or pyrolysis site. Thereafter, the pieces of solid waste 12 are caused to become somewhat homogeneously distributed within a fluidized bed 30, disposed near the bottom of an incineration vessel 26. While any conveyance may be used to so deposit the solid waste pieces 12 within the fluidized bed 30, including the direct injection of the pieces into the bed, a box conveyor 14 is illustrated in FIG. 1. Conveyor 14 comprises a conveyor belt 16 conventionally driven and displaced around either roller 17 whereby the solid waste pieces 12 fall into the vessel and are distributed by an impact cone 19 which is mounted on a column 21 and in turn supported by a cross member 23. Mechanisms may be used in conjunction with the box conveyor 14 to meter the rate at which solid waste pieces are fed into the incinerator. As a consequence, the pieces of solid waste 12, which, by way of example, may comprise wood waste and like stock refuge, are caused to be evenly distributed and embedded within the fluidized bed 30.

Depending upon the particular material and circumstances, pieces of solid waste 12 may be pre-dried before being fed into the incinerator, or water may be added thereto prior to or simultaneously with displacement into the incinerator. In any event, said pieces are subject to high temperature combustion, with or without carbonaceous residue, depending upon operating temperature, oxygen available and mode of operation.

A vapor zone 34, immediately above the fluidized bed 30 comprises a site where volatile matter, released by the pieces of solid waste 12 during combustion occurring in the fluidized bed, are in turn combusted spontaneously or by separate ignition means. Since the process is continuous, the heat of combustion within the fluidized bed and the heat of combustion in the vapor space complement each other so that operating temperatures are readily maintained, once established.

An air delivery system 32 drives air under pressure as indicated by arrows 40 from the source of pressurized air 25 upward into the fluidized bed 30 adequate to establish and sustain the requisite combustion. Initially, high temperature air under pressure is used, being obtained from a conventional air heater 42. Once the fluidized bed 30 has reached the desired operating temperature or slightly below that temperature, the air heater 42 is switched off and a high capacity squirrel cage blower 25 or the like continues to deliver ambient air to the fluidized bed. Blower 44 is driven by motor M1.

Gaseous exhaust passes from the vessel 26 through an effluent conduit 50 either directly into the atmosphere where the parts per million of solid particles in the exhaust do not exceed maximum limits permitted for the operating location in question, or through auxiliary mechanisms where such solid particle content is adequately reduced.

If and to the extent desired, heat may be recovered from the vessel 26 using a conventional boiler or the like. Also, the temperatures within the vessel 26 may be controlled by selecting an amount of moisture to be introduced into the vessel during operation.

With greater specificity, the fluidized bed vessel 26 comprises a right circular cylinder of sheet metal which is preferably insulated by refractory material along the inside thereof. A horizontally disposed top 27, also preferably insulated in the same fashion, seals the vessel except for influent air, influent solid waste pieces and effluent exhaust. For greater detail in the manner in which the vessel 36 and auxiliary features may be fabricated and assembled, reference may be had to my U.S. patent application Serial No. 354,812 filed April 26, 1973, the contents of which are incorporated herein by reference.

Openings 29, 31 and 33 accommodate introduction of solid waste pieces, introduction of influent air, and expulsion of exhaust, respectively.

The air delivery system 32 discharges air under pressure received from blower 25 along conduit 35 through opening 37 into air feed chamber 39. The air under pressure from chamber 39 is forced through apertures 41 and 43 in grid plate 45 directly into the fluidized bed and through bed nozzles 47, respectively. Preferably, adequate structural support for grid plate 45 is provided by conventional structural steel members (not shown). The grid plate 45, preferably of mild steel, is uniformly perforated by said apertures 41 and 43 in evenly arranged X and Y rows. The apertures are sized so as to readily permit influent air from the air delivery system 32 to pass through the plate 45 into the remainder of the fluidized bed 30, causing an even distribution of air. Cover caps 51 of the nozzles 47 are disposed essentially at the interface between the materials comprising the fluidized bed 30 and a tramp zone 53 whereby passage of the particulate matter of the fluidized bed through apertures 43 is prevented. In like fashion, plates 55 are preferably used to cover the apertures 41 for the same purpose as some of the tramp zone 53 will comprise particulate matter from the fluidized bed.

The fluidized bed 30 comprises a layer 59 of fine granular particulate matter, which preferably uniquely comprises eight to thirty mesh olivine sand, rests upon the perforated plate 45 and receives therein the previously mentioned solid waste pieces 12, causing incineration or pyrolysis thereof, depending upon selected operating temperatures and other variables. It is preferred that olivine sand of eight to thirty mesh size range be used to form particulate layer 59.

Surprisingly, research and development has established that a bed material comprising olivine sand results in superior performance both in reducing the tendency to fuse and cake and in the rate of particle breakdown and elutriation of the bed material, when compared with bed materials heretofore used. Olivine sand is a mineral of small particle size identified by the chemical compound (Mg,Fe) $SiO_4$. More specifically, olivine sand is available from the Olivine Corporation of 1015 Hilton Avenue, Bellingham, Washington 98225 and has either of the following compositions:

| | Mountain Quarry | Reef Point Quarry |
|---|---|---|
| Silica ($SiO_2$) | 40.08% | 42.2% |
| Iron ($Fe_2O_3$) | 8.82 | 6.4 |
| Alumina ($Al_2O_3$) | 2.22 | — |
| Calcium Oxide (CaO) | .24 | 18.4 |
| Magnesia (MgO) | 48.39 | 31.2 |
| Sodium ($Na_2O$) | 0.04 | |
| Potassium ($K_2O$) | 0.05 | |
| Chromite | | 0.2 |
| | 99.89 | 98.4 |

The size analysis of olivine sand is reported as follows:

| Retained on U.S. Screen Size | Weight Percent |
|---|---|
| #16 | 34.1% |
| #20 | 56.0 |
| #30 | 9.2 |
| #40 | 0.4 |
| pan | 0.3 |

The specific gravity of olivine is 3.22 to 4.39 and with a hardness rating of 6.5 to 7.0. It is a rhombic crystalline form and will vary in color from olive green to grayish green to a yellowish brown. The material in a particle size varying from a twelve mesh to thirty mesh material is preferred, (U.S. standare gauge screens). It has been found to have a low coefficient of thermal expansion, and is highly fracture resistant to the mechanical and thermal conditions to which it is subjected in the fluidized bed combustion process.

The test results are set forth in the attached copy of a publication entitled "TEST RESULTS OLIVINE SAND as a BED MATERIAL for the FLUID FLAME BURNER," by T. H. Daniels, dated Oct. 15, 1974, which is hereby incorporated herein by reference.

The entire bed, excluding tramp layer 55, may be on the order of nine inches to eighteen inches deep.

In respect to the bed nozzles 47 (FIG. 5), it has, surprisingly, been found that suitable bed nozzles, each disposed upon a stand pipe 61 (defining the height of the inactive zone 53) causes non-combustible larger sized material to be continuously removed from the active fluidized bed 30 thereby maintaining good quality bed properties at all times. It has been found that the apertures 43 in the grid plate 45 must permit enough air flow to allow the particulate matter of the bed to move upwardly under the force of said air. The apertures 41 are preferably of smaller size and serve fundamentally to purge a substantial part of the particulate matter of the fluidized bed from the tramp zone 53.

Figure 5:
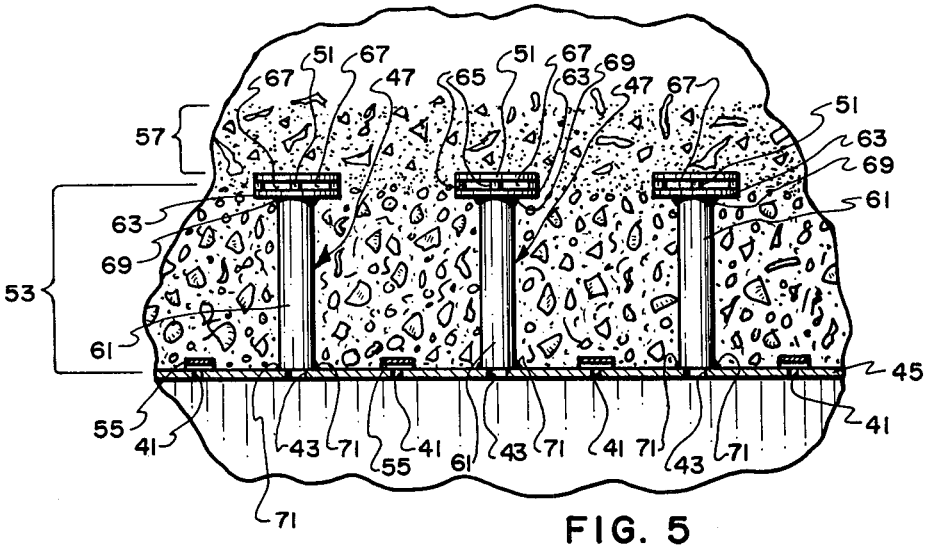
FIG. 5 shows an enlarged fragmentary elevation of one presently preferred fluidized bed nozzle configuration for isolation of tramp material.

It is to be appreciated that any one of a number of different types of bed nozzles may be used. Some suitable bed nozzles are illustrated in FIGS. 5–9. Each is mounted upon the stand pipe 61 and comprises a horizontal top or cover 51. In FIG. 5, the cover 51 is disc shaped, is mounted upon a base plate 63 using columns 65, which in combination define a plurality of radially disposed, horizontally directed air effluent port 67. The stand pipe 61 is welded to the base plate 63 at site 69. Each stand pipe 61 is likewise welded at sites 71 to the top of the grid plate 45.

Figure 6:
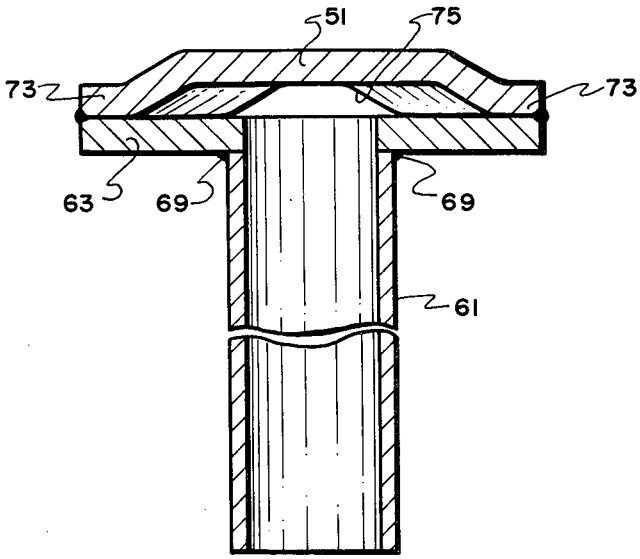
FIGS. 6—9 show in elevation with parts broken away for clarity various fluidized bed nozzles which may be used in conjunction with the configuration of FIG. 5.

With reference to FIG. 6, the cover plate 51 is downwardly configurated to create the horizontally extending lip 73, which is welded to the bottom plate 63 and interrupted at two locations 180° from each other to create air discharge ports 75.

Figure 7:
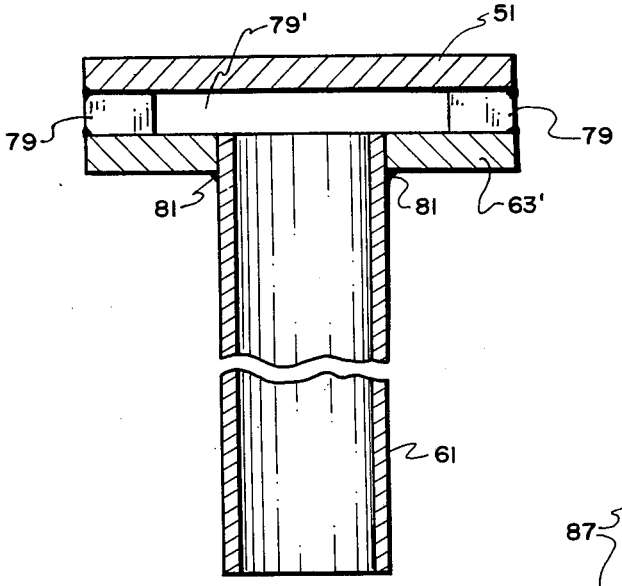

In reference to FIG. 7, the square cover plate 51 is mounted directly to the top of the stand pipe 61 by four spacers 79 located at each corner and secured at weld sites 77, with four radially disposed air discharge ports 79' between the four corner spacers 79. Air escaping from the ports 79' is channeled between the bottom surface of top cover plate 51 and the top surface of a lower square plate 63', the latter having a central aperture through which the stand pipe 61 extends and being welded to the stand pipe at sites 81.

Figure 8:
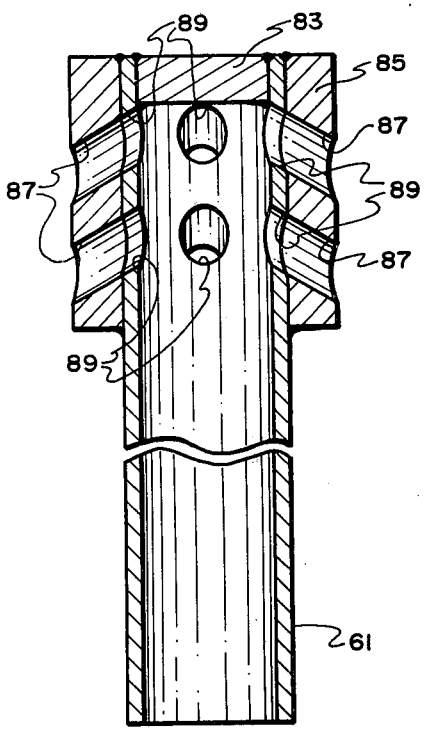

FIG. 8 is a further bed nozzle embodiment wherein the stand pipe 61 is closed at its upper end by plug 83 which is welded or otherwise suitably secured in position. An external cap 85 fits around the upper end of the stand pipe 61 and is likewise secured thereto by welding or the like. The cap 85 has a plurality of outwardly and downwardly extending bores 87, which are sized and shaped to match apertures 89 disposed in the upper end of the stand pipe 61. Thus, air emitted from the bed nozzle of FIG. 8 will be directed radially at an acute angle to the horizontal from the bores 87.

Figure 9:
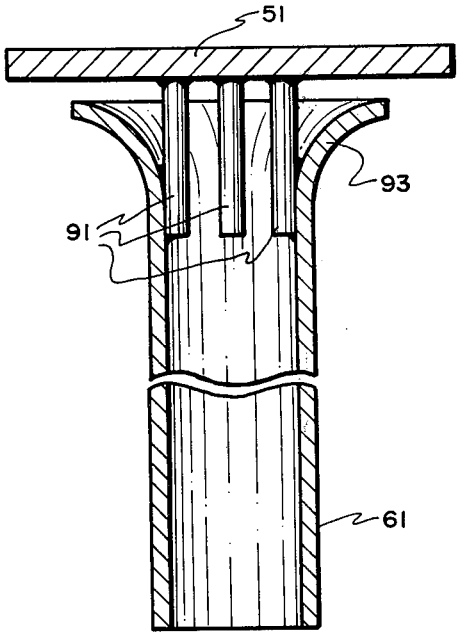
Figure 10:
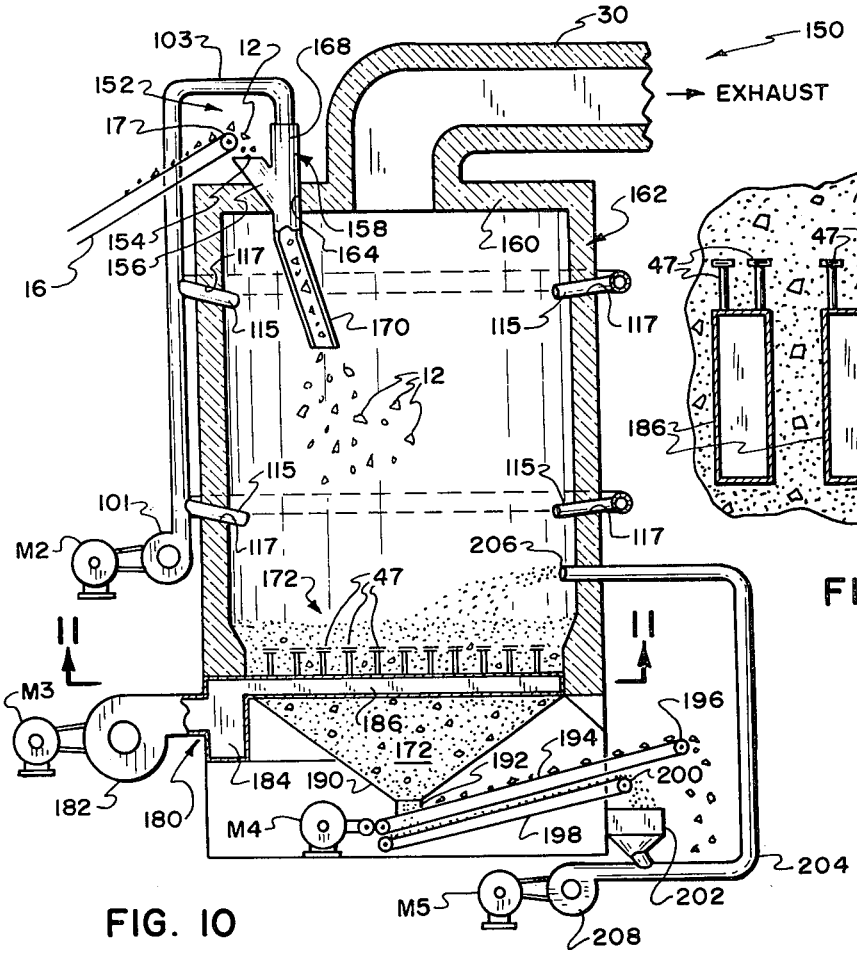
FIG. 10 is a vertical cross-sectional view of a second presently preferred embodiment of the present invention.
Figure 12:
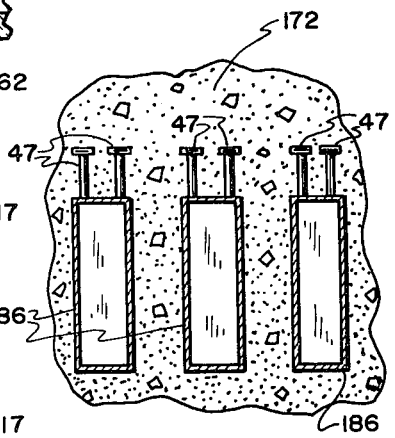
FIG. 12 is a cross-sectional view taken along lines 12—12 of FIG. 11.

The bed nozzle embodiment of FIG. 9 illustrates the cover plate 51 being supported upon and welded to a plurality of posts 91, the lower end of each post being welded to the interior of the stand pipe 61. The stand pipe 61 is flaired at its upper end 93, causing air expelled therefrom to be displaced generally radially in a horizontal plane beneath the cover plate 51.

Figure 2:
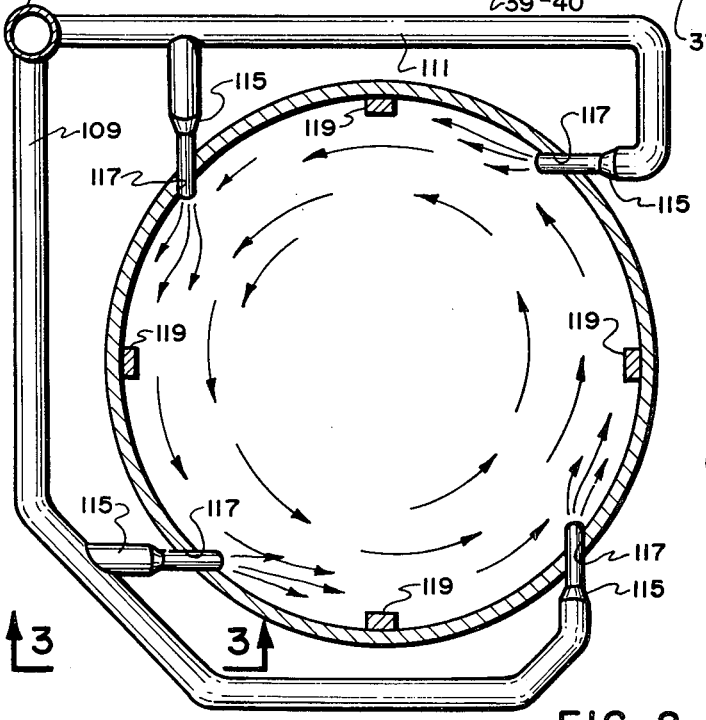
FIG. 2 is a plan view of the auxiliary air and nozzle system for creating an overfire air vortex.
Figure 3:
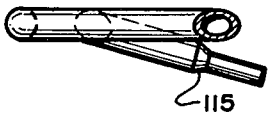
FIG. 3 is a view taken along line 3—3 of FIG. 2.
Figure 4:
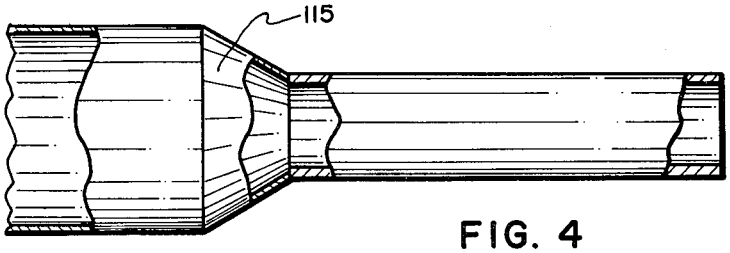
FIG. 4 is an enlarged elevational view of a presently preferred nozzle, four of which are shown in FIG. 2.

A novel vortex generator system is best illustrated in FIGS. 2–4. The system provides a source 101 of air under pressure which may be a squirrel cage blower driven by motor M2. It is preferred that motor M2 be a variable speed motor which may be regulated by the operator to control the rate at which air is introduced into the incinerator vessel 26 by the vortex generator system. Air issuing from the source 101 passes through main conduit 103 issuing into the incinerator vessel 26 through a plurality of discharge sites. The majority of the air from main conduit 103 is displaced into the vessel 26 through nozzle 105 which downwardly extends into the vessel tightly through opening 31 in the top 27 thereof. Air discharge from the nozzle 105 proceeds as indicated by arrows 107, coming in contact with the top surface of the fluidized bed 30 as a vertical column and being displaced essentially radially outward thereafter. Said influent air, which may be preheated as desired, is elevated in temperature once it reaches the vicinity of the fluidized bed 30 causing the same to commence to elevate along an annulus disposed between the cylindrical vertical wall of the vessel 26 and the column of influent air shown at arrows 107.

Air from the main conduit pipe 103 is channeled, as best illustrated in FIGS. 1 and 2, by auxiliary conduits 109, 111 and 113 to supply a plurality of vortex nozzles 115. The nozzles 115 may be of any suitable type, the configuration shown in FIG. 4 being acceptable. Each nozzle is fitted through the vertical wall of the vessel 26 at sites 117 at an acute angle in regard to the radius thereof such that air issuing from each nozzle 115, while not tangential initially becomes tangential immediately upon merging with the annulus of air being circulated between the interior surface of the vertical wall of the vessel 26 and the downwardly directed column of influent air 107. This phenomenon is best illustrated in FIG. 2. Preferably, as illustrated in FIG. 3, the nozzles 115 are directed at a very slight angle downward from the horizontal to restrict the rate at which the elevating vortex permits air to be discharged through outlet conduit 50.

Thus, air flow elevating from the fluidized bed is collected in an annular ring adjacent the walls of the vessel with the vortex nozzles discharging air at high velocity which intersects the annular gas stream causing rapid clockwise or counterclockwise rotation of the annulus of air, depending upon the direction in which the nozzles are directed, each nozzle being situated to complement the other nozzles in the rotation of the annular ring of air. There is interface mixing with the vertical column of influent air 107 and the conservation of momentum prevails resulting in vortical flow. It has been found that use of the vortex as herein described causes fine particlate matter from the fluidized bed to be centrifuged and returned to the bed. Also, the high velocity rotation prevents vertical channeling of air directly to the output 50 resulting in a far greater residence time for unburnt combustible particles. As a result, such small particles which are not otherwise centrifuged back into the fluidized bed are preserved in the vapor space above the bed untio they are consumed.

With additional reference to FIG. 2, it is to be observed that stagnation columns 119, at any desired location and in any desired numbers may be used to create a stagnation zone interfering with the otherwise high rotational velocity of small combustible particles aiding in their being returned to the fluidized bed.

In operation, incineration or pyrolysis of solid organic waste, using the present invention, will depend upon the operating temperature selected and available oxygen. It has been determined that a bed temperature slightly greater than 700° Fahrenheit, the volatile species emanating from the solid waste being consumed in the fluidized bed, are volatized, leaving a carbonaceous residue resembling charcoal in the bed. The reaction is slightly exothermic. The volatile species will burn smokelessly at about 1100° Fahrenheit or greater; the carbonaceous residue volatizes at 1000° Fahrenheit and burns completely at temperatures of 1200° Fahrenheit or greater. Thus, when total incineration is desired, the temperature in the vapor space 34 is maintained above 1100° Fahrenheit than that of the bed at 1000° Fahrenheit or above, producing energy which can be recovered using boilers or the like. Temperatures in and above the fluidized bed up to a maximum of 1900° Fahrenheit may be used without causing the bed material to react, either physically or chemically.

On the other hand, if it is desired to recover the carbonaceous material as a by-product, the bed is maintained at about 1000° Fahrenheit and, under these conditions, the volatile species will, as before, burn smokelessly in the vapor space 34. Also, if the operating temperature of the bed is between 700° Fahrenheit and 1100° Fahrenheit, an oxygen availability limited to less than five percent (5%) concentration of the carbonaceous residue, the volatile species will result and each may be utilized, thereafter, as a raw material in organic synthesis or other processes, or burned as natural gas in a separate combustion process.

It is to be appreciated that if spontaneous ignition of the volatile species in the vapor space 34 does not occur, an auxiliary burner may be used to facilitate this end result. To be certain of bed and space temperatures, it is preferred that temperature sensors of known design be appropriately placed within the interior of the vessel.

It has also been found that once the fluidized bed 30 has been preheated using heater 42 to a temperature on the order of 700° Fahrenheit, the volatile species issuing to the vapor space 34 are or can be ignited, increasing the vapor space and the bed temperatures to beyond the 1200° Fahrenheit level. Smoke free combustion of the volatile species results and total consumption of the carbonaceous solid residues, when total incineration is sought. The direct combustion air heater 42 is normally gradually shut down once the bed temperature reaches a level of 800° Fahrenheit and is completely shut off by the time a 1200° Fahrenheit operating temperatures is reached, thereby not using any of the available oxygen in the fluidizing air.

Reference is now made to the embodiment illustrated in FIGS. 10–13 and generally designated 150. Only those portions of the embodiment 150 which are materially the same as the corresponding portion of the already described embodiment 10 will not hereinafter be described, in order to avoid duplication.

Figure 13:
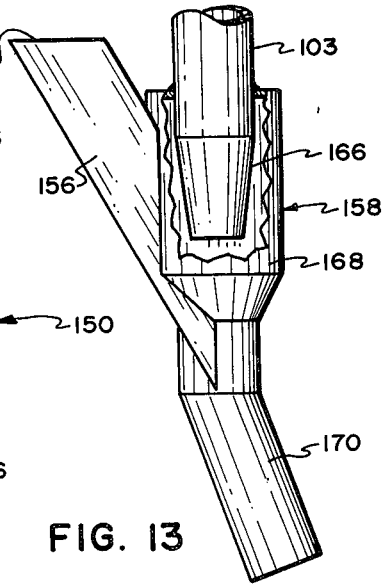
FIG. 13 is an enlarged elevational view of the fuel injection system of the embodiment of FIG. 10.

The solid organic waste low pollution incinerator 150 comprises a unique fuel feed system 152 which operates on the principle of an air jet pump. The fuel feed conveyor 16 turning at roller 17 dispatches by force of gravity solid waste particles 12 through an opening 154 in a fuel feed chute 156 comprising a side port of the bifurcated fuel influent mechanism 158. The bifurcated fuel influent mechanism 158 passes through the top 160 of the refractory lined vessel 162 at aperture 164. Air is fed from blower 101 through the main conduit pipe 103 as heretofore described, to a fuel injection air jet nozzle 166 (FIG. 13). Air under pressure emitted through nozzle 166 in a downward direction increases the air velocity at the output of the nozzle. The increased velocity results in a decreased static pressure in the region where the fuel feed chute 156 intersects the inlet air tube 168 of the bifurcated fuel injection mechanism 158. The decreased static pressure, in effect, creates a partial vacuum at the inlet to the fuel chute 154, thus virtually "sucking" the fuel into the chute 156. The outlet tube 170 is directed to the center of the active bed region within the vessel 162 and is at an acute angle in respect to the inlet air tube 168. The action of the high velocity air entering with the fuel tends to spread the fuel evenly over the surface of the bed within the vessel 162.

The fluidized bed 172 of the embodiment 150 is uniquely comprised of olivine sand.

Figure 11:
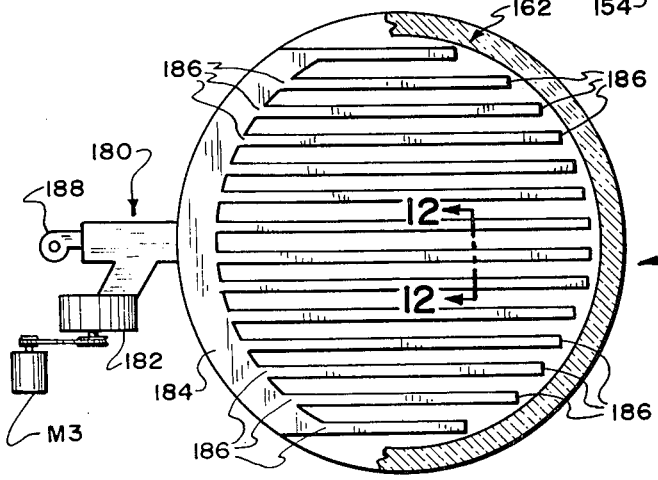
FIG. 11 is a cross-sectional view in plan of the embodiment of FIG. 10 taken along lines 11—11 of FIG. 10.

The embodiment 150 also comprises a new fluidizing air system 180 that allows continuous recirculation and purification of the bed material during normal burning operation in a fashion such that uncombustible "tramp" material, carried into the burner with the fuel, is continuously removed and eliminated. Fluidizing air is generated at main fluidizing blower 182, the squirrel cage or the like of which is caused to be rotated by motor M3 through a conventional V belt drive or the like. The fluidizing air is displaced from the blower 182 into a main fluidizing air manifold 184. As can be seen from FIG. 11, the manifold 184 extends over approximately 105° of the periphery adjacent the vessel 162 and is progressively constricted in both directions so as to create an even distribution of air into a plurality of rectangular ducts 186. The fluidizing air exiting from the manifold 184 is displaced into the parallel arrangement of rectangular ducts 186 which extend entirely across the bottom of the active bed area and are spaced one from the next such that the fluidizing nozzle pattern previously described in conjunction with the embodiment 10 is achieved without the use of a grid plate. The ducts 186 are properly shaped and sized to insure a uniform air flow to each duct and are of uniform width and spacing one to another so that the rate at which bed material and tramp material migrates between said ducts is a predetermined known magnitude. The parallel duct arrangement provides several advantages over the prior art including the grid plate technique, i.e. (a) the narrow duct widths allows free passage of the active bed material and tramp material to the cone shaped extraction bin below, (b) a relatively hot bed material passing between the ducts is cooled by the air within the ducts to a temperature compatible with the preferred carbon steel extraction bins, ducts, manifold and screens and at the same time the fluidizing air is preheated, and (c) the vibration of the ducts, caused by the flow of fluidizing air, insures the continuous, uniform passage of the entire contents of the bed to the cone shaped extraction bin and screen conveyors below. The length of the ducts varies from duct to duct because of the circular configuration of the illustrated refractory vessel 192. The free end of each duct is capped and preferably supported upon an expansion mechanism to accommodate thermal expansion and contraction lengthwise while securing against lateral displacement. With the indicated arrangement, essentially the same magnitude of air is discharged from each nozzle 47. The influent to manifold 184 may be heated if desired by an auxiliary burner 188 (FIG. 11).

The granular bed material and tramp material passing adjacent the ducts fills the space created by and is supported by a cone shaped bin 190, having a major diameter equal to the diameter of the active bed of the vessel 162 and a minor diameter which terminates in a vertical pipe or spout 192. The cone may be either a static cone or a dynamic vibrating cone or a two section cone having both a static and a dynamic section. The spout discharges vertically onto a vibrating screen conveyor 194, which is driven by motor M4 so as to oscillate. The screen conveyor 194 separates reusable bed material from tramp material with the tramp material proceeding up the conveyor 194, off the elevated end 196 and discarded. The reusable bed material passes through the mesh of the conveyor 194 onto a lower conveyor 198 and is discharged from the elevated end 200 thereof into a bed material storage bin 202 into a bed material return conduit 204 along which the return bed materially is displaced and ultimately out effluent end 206 thereof onto the fluidized bed 172 within the vessel 162 under force of blower 208 driven by motor M5. Thus, tramp material is removed and the bed material is continuously recirculated for reuse. The bin 202 also provides a convenient point for the addition of new "makeup" bed material which is required from time to time during normal operation of the embodiment 150, due to particle elutriation and attrition caused by particle fracture and abrasive wear. In this way, the bed inventory is maintained at the optimum level for proper fluidization.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An incineration system comprising:

a generally cylindrical incineration chamber;

a fluidized bed located within the chamber with a vapor space defined in the chamber above the fluidized bed;

means causing combustible waste to be introduced into the incineration chamber and dispersed within the fluidized bed;

effluent opening means above the vapor space communicating exhaust from the interior of the chamber;

influent air means communicating air into the interior of the chamber and being disposed centrally above the fluidized bed directing said air centrally downward against the fluidized bed and causing air to elevate within the chamber as an annulus adjacent the wall of the chamber;

auxiliary influent air means communicating air into the interior of the chamber adjacent the wall of the chamber within the vapor space with at least the major component of air displaced therefrom being tangential to the wall when introduced into the chamber;

whereby a gradually elevating annular vortex of air is created whereby fine particles are centrifuged from the vapor space to the fluidized bed and vapor space residence time for any residual particles is increased accommodating complete combustion.

2. The incineration system according to claim 1 wherein the interior of said generally cylindrical incineration chamber comprises at least one vertical stagnation column adjacent the interior surface of the wall of the chamber which interferes with the periphery of said elevating annular vortex and aids in returning fine particles from the vapor space to the fluidized bed.

3. An incineration system comprising:

a vessel;

means for introducing fuel into the vessel;

means for introducing air into the vessel adequate to support combustion;

the improvement comprising a fluidized bed within the vessel initially containing and maintaining olivine sand in an unreacted state to enhance the physical properties of the bed and means establishing and maintaining the operating temperature of the olivine at a level on the order of 700° F – 1900° F.

4. An incineration system comprising:

a vessel;

means for introducing fuel into the vessel;

a fluidized bed of non-agglomerated sand particles disposed within the vessel;

means for elevating the temperature of the bed to on the order of about 700° F – 1900° F.

means for introducing air into the fluidized bed comprising source means of air under pressure, an air distribution system disposed beneath the fluidized bed and comprising a plurality of ducts, a manifold interposed between the source means and the ducts and a plurality, of nozzles located within the fluidized bed, the nozzles being mounted to and receiving air from the ducts, said ducts being spaced one from the next;

generally vertical passageways of substantial width between said spaced ducts defining regions through which contaminated sand particles migrate downwardly from the fluidized bed.

* * * * *